US007187341B2

(12) United States Patent
Lee

(10) Patent No.: US 7,187,341 B2
(45) Date of Patent: Mar. 6, 2007

(54) ANTENNA APPARATUS HAVING A REFLECTOR

(75) Inventor: Chang-Jung Lee, Taoyuan (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/080,046

(22) Filed: Mar. 15, 2005

(65) Prior Publication Data

US 2005/0206577 A1 Sep. 22, 2005

(30) Foreign Application Priority Data

Mar. 17, 2004 (TW) ..... 93107032 A

(51) Int. Cl.
*H01Q 19/10* (2006.01)

(52) U.S. Cl. ..... 343/837

(58) Field of Classification Search ..... 343/895, 343/702, 795, 834, 817, 700 MS, 835, 836, 343/839

See application file for complete search history.

(56) References Cited

U.S. PATENT DOCUMENTS 5,392,049 A * 2/1995 Gunnarsson ..... 342/42
6,320,509 B1 * 11/2001 Brady et al. ..... 340/572.7
6,441,740 B1 * 8/2002 Brady et al. ..... 340/572.7
6,639,717 B2 * 10/2003 Sugiyama ..... 359/399

* cited by examiner

*Primary Examiner*—Shih-Chao Chen
*Assistant Examiner*—Minh Dieu A
(74) *Attorney, Agent, or Firm*—Thomas, Kayden, Horstemeyer & Risley

(57) ABSTRACT

The present invention discloses an antenna apparatus comprising a reflector including a V-like structure (from the cross-sectional view) with an angle. A radiation unit (antenna) is set within the V-like structure. The angle is about 120 degree. The V-like structure includes a fixing plate, a first side plate attached on a first edge of the fixing plate and a second side plate attached on a second edge of the fixing plate, thereby constructing the angle.

11 Claims, 6 Drawing Sheets

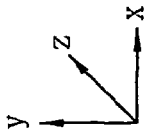
Fig. 3A
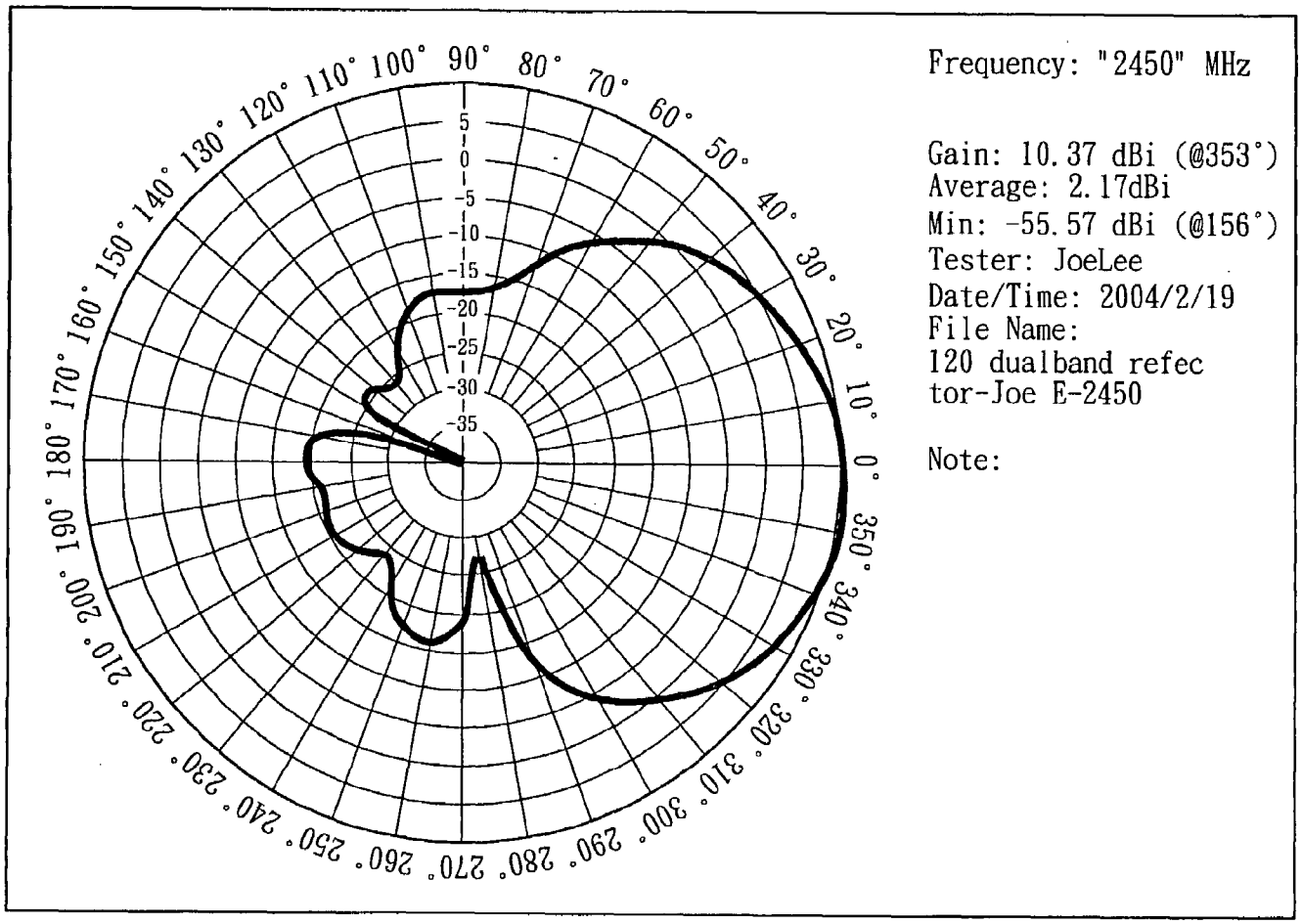

ANTENNA APPARATUS HAVING A REFLECTOR

FIELD OF THE INVENTION

The present invention relates to an antenna apparatus, and more particularly, to an antenna apparatus having a V-like structure reflector.

BACKGROUND OF THE INVENTION

Various types of antennas are rapidly improvement along with the development of the communication technology. The IC technology is also developed with fast pace to provide a product with smaller size and lighter weight. The volume fact is one of important considerations to the antenna used for transmitting and receiving signal. One goal of the manufacture is to achieve the small product with light weight.

Antenna is employed to transmit or receive EM wave for communication technology. The characters of the antenna can be obtained from the operating frequency, radiation pattern, return loss and antenna Gain. Small size, good performance and low cost are the most important facts for the current antenna to share larger marketing.

In general, the antennas employ a reflector to reflect the EM wave transmitted by the antennas for directing the EM wave towards a pre-determined direction. In order to constrain the EM wave direction, the reflector is configured with a spherical shape or other curved surface, generally. The waves reflected from the above reflector may propagate towards a direction so as to improve the directivity and gains.

However, the well-known reflectors are shaped as spherical shape or other curved surface. In order to precisely control the focus location of the reflector, it leads to the manufacture procedure is complicated and the cost of manufacture is high. Particularly, it is unlikely to minimize the size of such reflector.

Further, the conventional antenna suffers the multi-path effect when the device is used in a house or indoor. The signal is interrupted and unstable, thereby reducing the transmission quality.

Thus, what is desired is to develop an antenna to meet the requirement of improved reflection effect, easy to manufacture and is adapted to the indoor usage.

SUMMARY

The object of the present invention is to provide an antenna with a reflector for reducing the manufacture cost.

The further object of the present invention is to provide an antenna that is adapted to the indoor usage.

The present invention discloses an antenna apparatus comprising a reflector including a V-like structure (from the cross-sectional view) with an angle. A radiation unit (antenna) is set within the V-like structure. The angle is about 120 degree. The V-like structure includes a fixing plate, a first side plate attached on a first edge of the fixing plate and a second side plate attached on a second edge of the fixing plate, thereby constructing the angle. The shape of the first and second side plates is a square or rectangular. Similarly, the shape of the fixing plate is a square or rectangular. The radiation unit keeps a distance to the fixing plate. The distance is about between 0.6λ to λ of the operation frequency of the antenna (radiation unit or radiator). The radiation unit is an omni-directional antenna or a sleeve antenna. The radiation unit is substantially parallel to the fixing plate.

The length of the first side plate and the second side plate is approximately between 0.25λ to λ of the operation frequency, while the width of the first side plate and the second side plate is approximately between 0.75λ to 3λ of the operation frequency. The width of the fixing plate is approximately between (1/12) λ to (1/4) λ of the operation frequency.

FIG. 3A shows the radiation pattern on the y-z plane during the operation of 2.450 GHz.

DETAILED DESCRIPTION OF THE PRESENT INVENTION

Figure 1A:
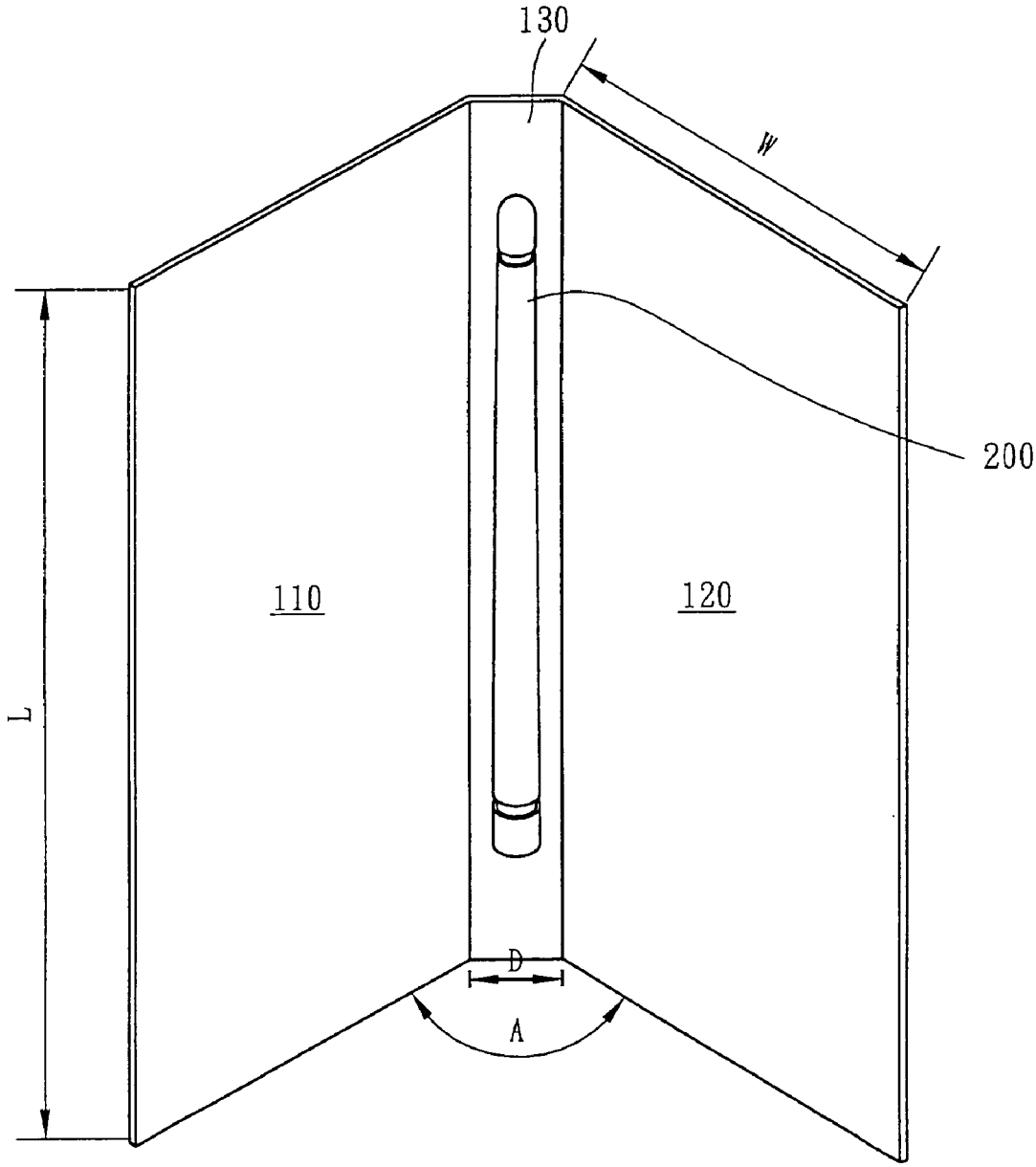
FIG. 1A to FIG. 1C illustrate the configuration of the antenna apparatus according to the present invention.
Figure 1B:
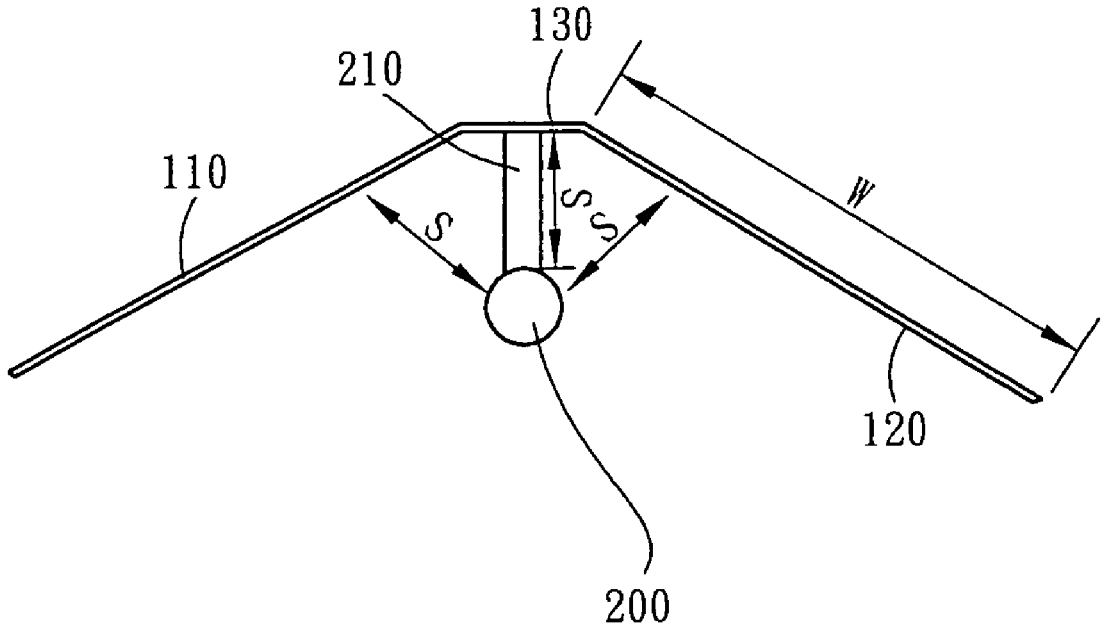
Figure 1C:
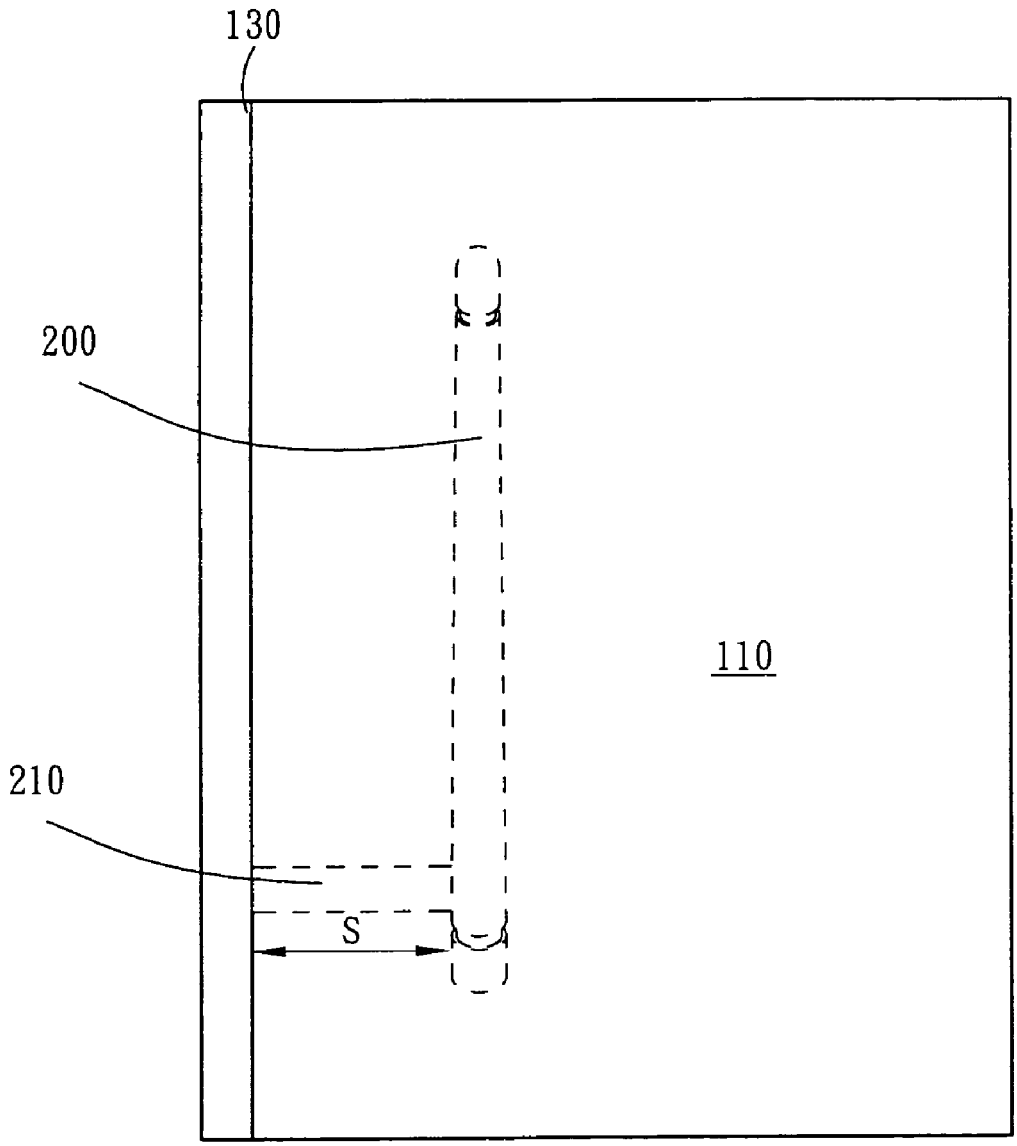

Please refer to FIGS. 1A to FIG. 1C, they illustrate the preferred embodiment of the present invention. The antenna apparatus includes a reflecting structure and an antenna 200 (radiator or radiation unit). The reflecting structure is constructed by a fixing plate 130, a first side plate 110 and a second side plate 120. The shape of the fixing plate 130 could be square or rectangular including a first edge and a second edge. One side of the first side plate 110 is attached on the first edge of the fixing plate 130. Similarly, one side of the second side plate 120 is also attached on the second edge of the fixing plate 130. The first side plate 110 is opposite to the second side plate 120. The first side plate 110, the fixing plate 130 and the second side plate 120, therefore, construct the V-like structure with an angle between the first side plate 110 and the second side plate 120. Preferably, the angle is around 120 degree. The antenna (or the radiation unit) 200 is set within the V-like structure. Namely, the antenna 200 is surrounded by the first side plate 110, the fixing plate 130 and the second side plate 120, as shown in FIG. 1A to FIG. 1C. Please refer to FIG. 1B to FIG. 1C, the antenna 200 is attached on the fixing plate 130 through a connecting base 210.

Beside, the material of the reflector is metal or other material that could reflect the EM wave, preferably. Further, the shape of the first side plate 110 and the second side plate 120 could be square, circle, ellipse or the like. The length and width of the first side plate 110 and the second side plate 120 are indicated by L and W, respectively. The shape of fixing plate 130 includes a rectangular (or square) shape with a length L and a width D. The length of the edge of the first side plate 110 and the second side plate 120 could be L for the embodiment. The dimension L is set approximately between 0.25λ to λ of the operation frequency, while the dimension W (width) of the first and second side plates 130 is set approximately between 0.75λ to 3λ of the operation frequency. The dimension of D is approximately between (1/12) λ to (1/4) A of the operation frequency. The antenna 200 (radiation unit) is spaced apart from the fixing plate 130 with a distance S. The S is approximately between 0.6λ to λ of the operation frequency. By adjusting the distance S, the incident angle of the EM wave into the reflector can be controlled, thereby controlling the radiation pattern of the antenna 200. The preferred operation frequency is about 2.45 GHz, the fixing plate 130 is used for attaching the antenna 200 rather than reflecting the EM wave. Therefore, the dimension of the D (width of the fixing plate 130) is the shorter the better. The reflector structure could be formed by single one piece or constructed by pluralities of parts.

Figure 2:
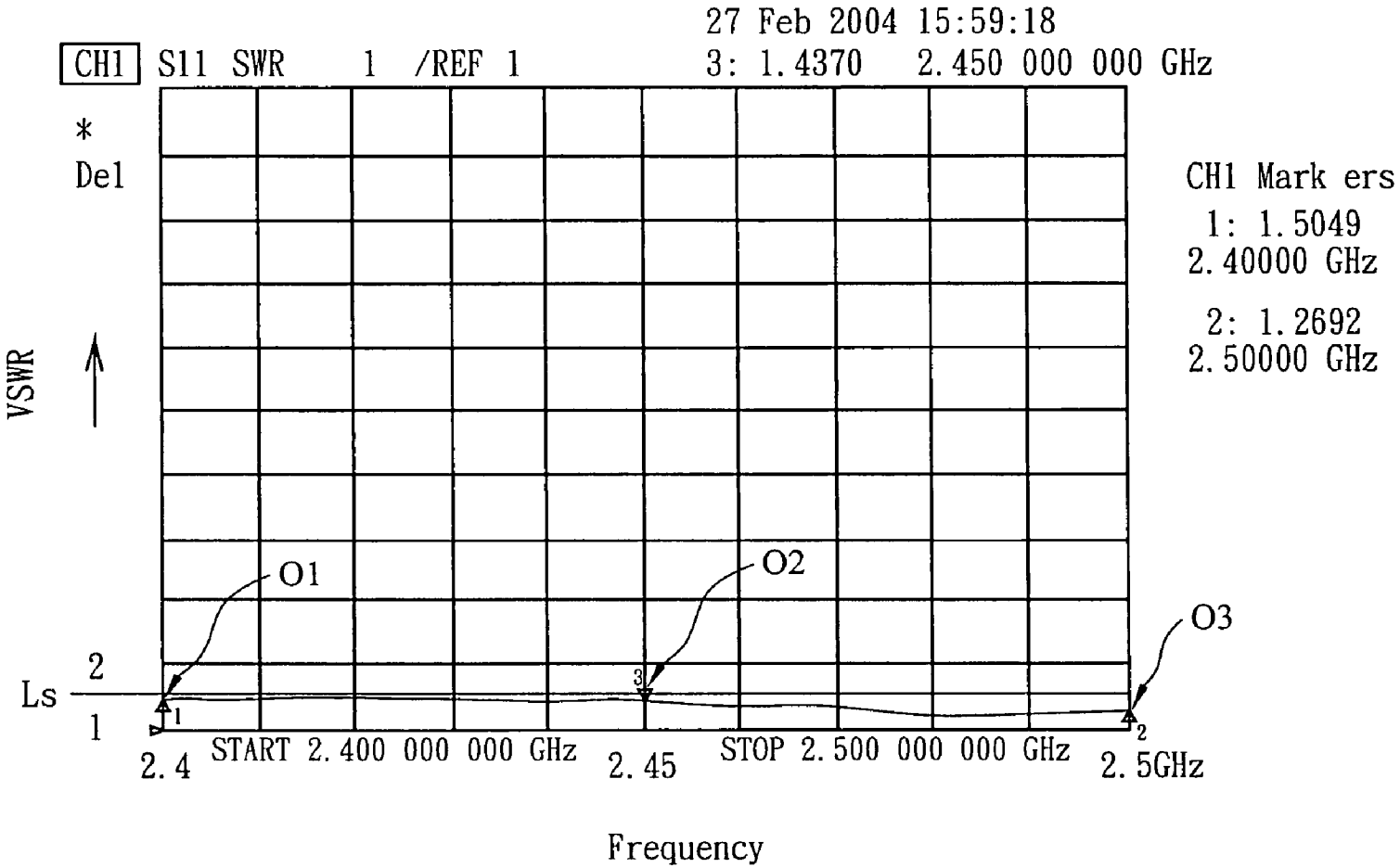
FIG. 2 illustrates standing wave ratio data according to the present invention.

The antenna of the present invention could be an omni-direction antenna, a sleeve antenna or other directional antenna. The V-like structure of the present invention could constrain the propagation direction of the EM wave. After the experiment, the present invention may reduce the multi-path effect and improve the directivity, quality and gain. After the actual measurement, turning to FIG. 2, it shows the standing wave ratio-frequency illustrations. When the operating frequency is about 2.4 GHz (operation point O1), the standing wave ratio is about 1:1.5049, while the operating frequency is about 2.45 GHz (O2), the standing wave ratio is about 1:1.4370. If the operating frequency is about 2.5 GHz (O3), the standing wave ratio is about 1:1.2692. The operating points O1, O2, O3 are all lower than Ls which indicates that the standing wave ratio is 1:1.6. Therefore, the band-width of at least about 100 MHz can be achieved by the present invention when the operation frequency of the antenna is about 2.45 GHz.

Figure 3B:
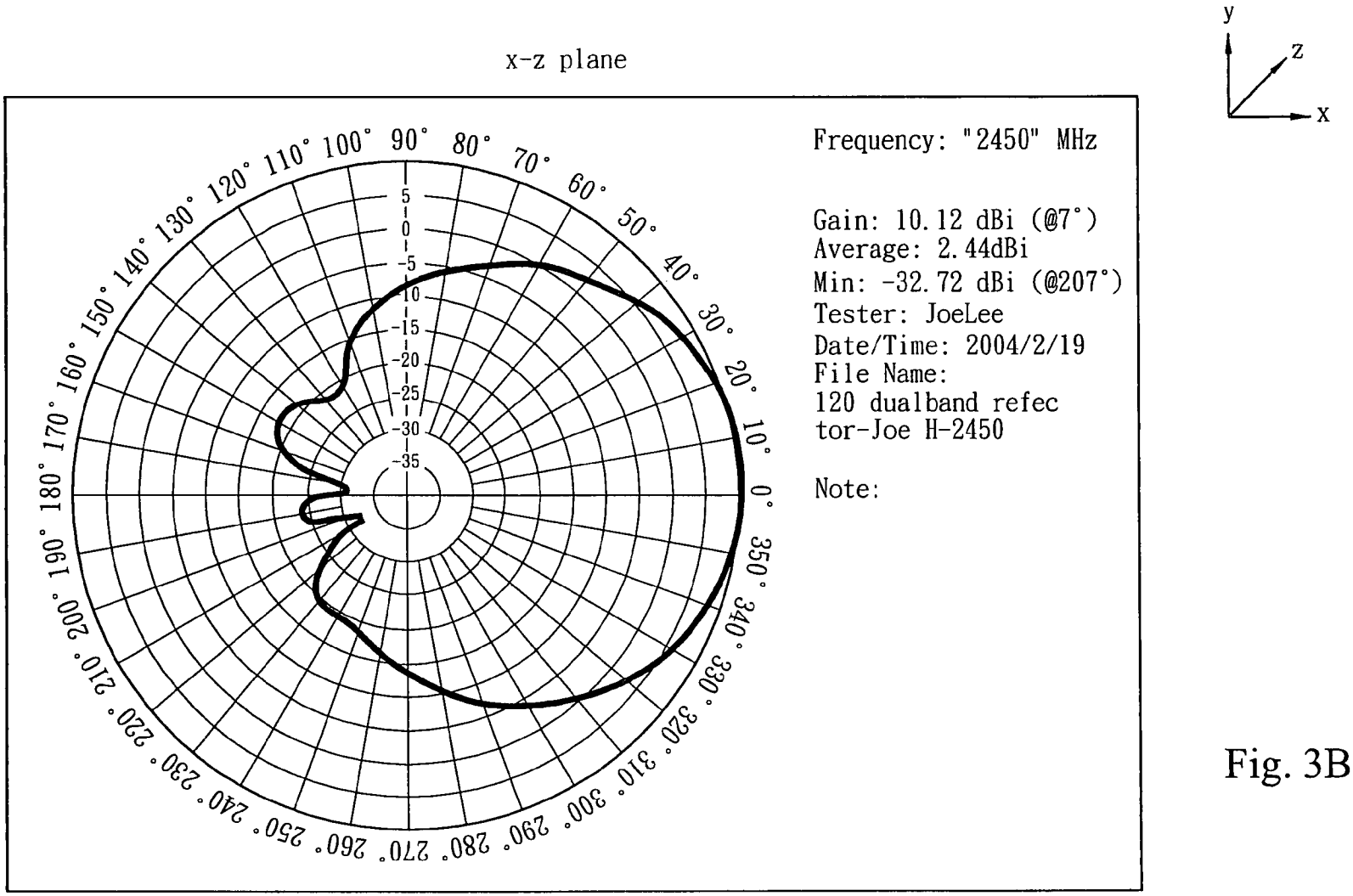
FIG. 3B illustrates the x-z plane radiation pattern under the operation of 2.450 GHz.

Please refer to FIG. 3A–3B, FIG. 3A shows the radiation pattern on the y-z plane during the operation of 2.450 GHz. FIG. 3B illustrates the x-z plane radiation pattern under the operation of 2.450 GHz. From the data, the y-x and x-z plane shows that the radiation patterns are perfect circles. They meet the requirements.

The benefit of the antenna includes simple structure, small size, low cost and omni-direction. The antenna with the reflector may achieve the high gain object, thereby significantly reducing the manufacture cost.

Although specific embodiments have been illustrated and described, it will be obvious to those skilled in the art that various modifications may be made without departing from what is intended to be limited solely by the appended claims.

What is claimed is:

1. An antenna apparatus with a reflector, comprising:

a reflector including a V-like structure, the V-like structure including a fixing plate, a first side plate attached on a first edge of said fixing plate and a second side plate attached on a second edge of said fixing plate, thereby constructing an angle of about 120 degrees;

a radiation unit set within said V-like structure; and a connecting base that attaches the radiation unit to the fixing plate of the V-like structure.

2. The antenna apparatus of claim 1, wherein the shape of said first and second side plates is a square or rectangular.

3. The antenna apparatus of claim 1, wherein the shape of said fixing plate is a square or rectangular.

4. The antenna apparatus of claim 1, wherein the length of said first side plate and said second side plate is approximately between 0.25λ to λ of the operation frequency.

5. The antenna apparatus of claim 1, wherein the width of said first side plate and said second side plate is approximately between 0.75λ to 3λ of the operation frequency.

6. The antenna apparatus of claim 1, wherein the width of said fixing plate is approximately between (1/12) λ to (1/4) λ of the operation frequency.

7. The antenna apparatus of claim 1, wherein said radiation unit keeps a distance to said fixing plate.

8. The antenna apparatus of claim 7, wherein said distance is about between 0.6λ to λ of the operation frequency.

9. The antenna apparatus of claim 1, wherein said radiation unit is an omni-directional antenna.

10. The antenna apparatus of claim 1, wherein said radiation unit is a sleeve antenna.

11. The antenna apparatus of claim 1, wherein said radiation unit is substantially parallel to said fixing plate.

* * * * *